United States Patent [19]

Bakshani et al.

[11] Patent Number: 4,738,718

[45] Date of Patent: Apr. 19, 1988

[54] METHOD FOR THE RECOVERY OF GOLD USING AUTOCLAVING

[75] Inventors: Nandkumar Bakshani, New Orleans, La.; Peter H. Yu, Harvey, La.

[73] Assignee: Freeport Minerals Company, Orleans, La.

[21] Appl. No.: 792,025

[22] Filed: Oct. 28, 1985

[51] Int. Cl.[4] ..... C22B 11/04

[52] U.S. Cl. ..... 75/105; 75/106; 75/108; 75/118 R; 423/29; 423/30; 423/31; 423/34

[58] Field of Search ..... 75/101 R, 105, 118 R, 75/106, 108; 423/27, 29, 30, 31, 47, 144, 34

[56] References Cited

U.S. PATENT DOCUMENTS

| | | | |
|---|---|---|---|
| 820,810 | 5/1906 | Muffly | 423/29 |
| 2,187,750 | 1/1940 | Marvin | 423/27 |
| 3,764,650 | 10/1973 | Scheiner et al. | 423/38 |
| 4,084,961 | 4/1978 | Caldon | 75/101 R |
| 4,113,471 | 9/1978 | Langhorst et al. | 75/118 R |
| 4,128,462 | 12/1978 | Ghiringhelli et al. | 204/109 |
| 4,139,432 | 2/1979 | Ghiringhelli et al. | 204/110 |
| 4,229,209 | 10/1980 | Kindig et al. | 75/1 R |
| 4,244,734 | 1/1981 | Reynolds et al. | 75/101 R |
| 4,256,706 | 3/1981 | Heinen et al. | 423/29 |
| 4,266,972 | 5/1981 | Redondo-Abad et al. | 423/41 |
| 4,269,622 | 5/1981 | Kerley | 423/32 |
| 4,289,532 | 9/1981 | Matson et al. | 423/29 |
| 4,369,061 | 5/1983 | Kerley | 75/118 R |
| 4,378,275 | 3/1983 | Adamson et al. | 75/118 R |
| 4,431,614 | 2/1984 | Makipirtti et al. | 423/29 |
| 4,438,076 | 3/1984 | Pietsch et al. | 75/118 R |
| 4,442,072 | 4/1984 | Baglin et al. | 75/101 R |
| 4,552,589 | 11/1985 | Mason et al. | 423/29 |

*Primary Examiner*—Robert L. Stoll

*Attorney, Agent, or Firm*—Fisher, Christen & Sabol

[57] ABSTRACT

A gold recovery pretreatment process is disclosed in which the gold content is more completely extracted from refractory sulfidic ores which contain large quantities of metal carbonates such as dolomite than occurs in traditional gold extraction methods. The process includes treating the ore in an autoclave at elevated temperature and oxygen overpressure conditions in the presence of soda ash or other alkaline materials. The autoclaving of the slurried ore is performed for a sufficient amount of time to oxidize the sulfidic compounds in the ore. The oxidized ore is then more amenable to subsequent conventional gold extraction techniques.

16 Claims, 1 Drawing Sheet

METHOD FOR THE RECOVERY OF GOLD USING AUTOCLAVING

BACKGROUND OF THE INVENTION

1. Field of the Invention

This invention relates generally to a method for the recovery of gold from refractory ores. More specifically, this invention relates to a method for the recovery of gold from refractory sulfidic ores which contain large quantities of metal carbonates such as dolomite.

2. Prior Art

In recent years the mining industry has become increasingly involved with developing methods for extracting gold from complex refractory ores. This trend is due to the increasing scarcity of free milling gold ore deposits. Gold ores are refractory when their gold content is closely associated with metallic sulfides in the ore. The metallic sulfides found in gold ore are substantially pyrite and pyrite derivative compounds such as arsenopyrite. Although sulfidic refractory ores have been known and studied for years, the actual chemistry involved with their refractory nature is not clearly understood. Additionally, sulfidic ores vary considerably between deposits in both the refractory nature and the mineral content of the ore. The mining industry has developed a number of different processes to extract gold from sulfidic ores.

U.S. Pat. No. 4,266,972 to Redondo-Abad et al. discloses a method for treating a sulfidic ore containing precious metals and base metals under an oxygen pressure of about 5 to 15 $Kg/cm^2g$ (71 to 213 psig) at a temperature of 150° C. to 250° C. The sulfidic ore is leached under these conditions by water to dissolve zinc and copper, hydrolyze iron to hematite, and leave lead and precious metals as insoluble sulfates. The lead, silver, and gold are leached from a solid residue by a strong chloride solution containing calcium chloride at a temperature in the range of about 60° C. to 90° C., at a pH in the range of about 7.0 to 1.0 and in the presence of about 1 gram per liter of ferric chloride.

U.S. Pat. No. 4,431,614 to Makipirtti et al. discloses a method for the separation of gold and silver from complex sulfide ore. The method of this invention involves heating the sulfide ore at a temperature of 600° C. to 900° C. at a sulfur pressure of 0.2 to 1 atmosphere to bring the complex metal compounds to a suitable form for a subsequent alkaline cyanide leaching. The gold and silver is then dissolved by a cyanide solution and separated from the insoluble residue. This method uses a leaching time of about 8 hours and obtains yields of silver at about 48 percent and yields of gold at about 96 percent.

U.S. Pat. No. 4,438,076 to Pietsch et al. discloses a method for extracting gold and silver from an ore. This method involves a process for leaching gold and silver from an ore in an alkaline cyanide solution. The leaching is performed by maintaining the slurry in a turbulent state at a pressure of 25 to 130 bar (363 to 1886 psig) while injecting oxygen into the slurry as the slurry passes through a tube reactor in a continuous unidirectional flow. The oxygen having a purity of at least 90 percent is injected such that the $CN/O_2$ molar ratio is at most 0.7 at 25 and 0.7 g/l NaCN. The $CN/O_2$ molar ratio is lower than 0.7 at pressures higher than 25 bar. The slurry temperature is 70° C. or less during this reaction. Lime can be used to adjust the slurry pH. The method requires a tube reactor which does not readily lend the process to large scale industrial gold extraction operations.

U.S. Pat. No. 4,442,072 to Baglin et al. discloses a method for the selective recovery of base metals and precious metals from ores. The ores are smelted with a flux to form a matte and slag. The matte is subsequently ground and leached with about 10 to 40 weight percent sulfuric acid at a temperature of about 40° C. to about 100° C. at atmospheric pressure. This step selectively solubilizes nickel and iron in the ore after leaching. The ore is roasted at about 300° C. to 500° C. and further leached with dilute sulfuric acid at ambient temperature and pressure to extract copper. The remaining residue has a high concentration of platinum, palladium, and gold.

Extracting gold from refractory sulfidic ores is made more difficult when the ores contain large amounts of basic metal carbonates. One of the most common metal carbonates found in gold ores is dolomite. Pressure leaching processes using acid as the leaching agent have been used with refractory sulfidic ores. An acid pretreatment step can be utilized when there is only a small amount of dolomite in the ore.

U.S. Pat. No. 4,084,961 to Caldon discloses a method for the treatment of metal bearing mineral material. This invention is a pressure leaching process that can be preceded by an optional acid pretreatment step wherein sulfuric and nitric acids are used to remove unwanted metal carbonates from the ore. This reaction is conducted under pressurized oxygen at elevated temperatures. Ores having high concentrations of carbonates consume a correspondingly higher amount of acid in pretreatment steps. This adds to the overall expense of the gold leaching operation. In addition, the use of corrosive acids in either a pretreatment step or in a pressure leaching step can necessitate the use of expensive corrosion resistant materials in the equipment in which the acid treatment operation is conducted.

An example of an economical method for the recovery of gold from refractory carbonaceous ores is U.S. Pat. No. 4,289,532 to Matson et al. herein incorporated by reference. Refractory carbonaceous ores owe their refractory nature to their carbon content rather than to their sulfidic content as do the ores whose recovery is the object of the present invention. This method subjects ores to simultaneous cyanidation and countercurrent granular activated carbon adsorption in two or more stages. Prior to cyanidation this method includes an oxidation procedure, such as an oxygenation and/or chlorination procedures to make the carbonaceous ore more amenable to cyanidation. This method has been proven to be an economical process for recovering gold from very refractory carbonaceous ores, but provides less than desirable results with refractory ores that possess both sulfidic and carbonaceous characteristics.

The industry is lacking an effective, acid-free method of recovering gold from sulfidic ores which are refractory to conventional cyanidation techniques and which contain large quantities of basic metal carbonates.

SUMMARY OF THE INVENTION

This invention is a method for recovering gold from a refractory sulfidic gold-containing ore by oxidizing a slurry of the ore. Oxygenation occurs in an autoclave at between about 400° F. and about 500° F. with an oxygen overpressure of between about 50 psig and about 100 psig for at least 2 hours. This oxidation step occurs before a cyanide leach of the ore.

In typical gold extraction processes the method of this invention includes grinding a refractory gold-containing ore having sulfidic material such that 90 percent of the ore passes through a 100 U.S. mesh screen. These ores typically contain at least about 8 percent dolomite impurity. The ground ore is slurried with water to a solids content of between about 20 and about 45 percent by weight. Soda ash ($Na_2CO_3$) is added at the rate of about 50 to 100 pounds per ton of dry ore. Lime (CaO) or caustic soda (NaOH) can be used in place of soda ash. Soda ash is the preferred alkaline agent because of its cost effectiveness when compared to the other agents. The ore slurry is then fed to an autoclave wherein the slurry is continuously agitated. Steam and oxygen are fed to the autoclave such that the autoclave is operated at between about 400° F. and about 500° F. with an oxygen overpressure of between about 50 psig and about 100 psig. The residence time per unit of volume of slurry in the autoclave is at least 2 hours. Desirably the autoclave has baffles to increase the turbulence and decrease "short circuiting" of the ore slurry flow through the autoclave. The oxidized ore slurry exits the autoclave and is ready for cyanide leaching. Optionally, a liquid-solid separation step can be included to remove a portion of the slurry water and consequently increase the percent of solids in the slurry. This effectively increases the residence time of the solids in the slurry during the cyanide leach step.

In the most desirable embodiments of this invention the cyanide leaching is simultaneously performed with a carbon-in-pulp adsorption step. The gold-loaded activated carbon is then separated from the ore slurry and the gold is removed or stripped from the activated carbon using standard techniques. The stripped gold can be further refined.

DETAILED DESCRIPTION OF THE INVENTION

Figure 1:
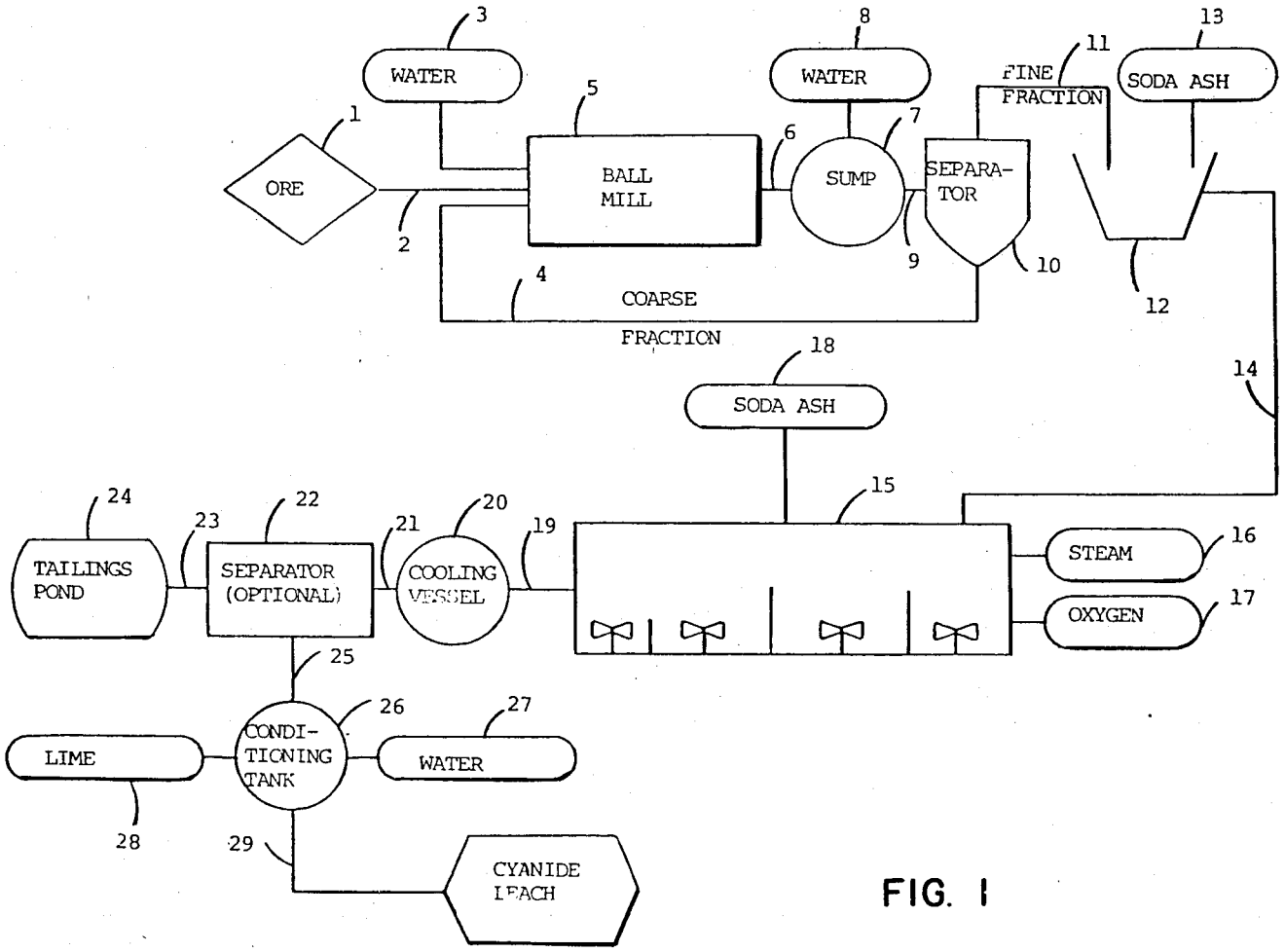
FIG. 1 is a flow diagram of the preferred embodiment of the invention.

This invention is a method for recovering gold wherein an oxidizing step is utilized before the traditional cyanide leach operation. In the method of this invention a slurry of a refractory sulfidic gold-containing ore is formed in the presence of an alkaline material. The slurry is then subjected to a first oxidation step which includes the simultaneous autoclaving and oxygenating of the slurry. The slurry is then cooled to about ambient temperature. The pH of the slurry is adjusted to about 10. Desirably, the cyanide leach step involves the simultaneous complexing of gold in the slurry with the cyanide ions and adsorbing the gold onto activated carbon. In this manner, the gold-loaded activated carbon can be separated or removed from the slurry.

The method of this invention is intended as a pretreatment operation in which refractory sulfidic gold-containing ore is conditioned for a subsequent conventional leach operation. The invention is described herein with regard to its use in the cyanide leach technique detailed in U.S. Pat. No. 4,289,532 to Matson. The Matson process as discussed above subjects gold-containing ores to two or more stages of simultaneous cyanidation and adsorption on countercurrent flowing granular activated carbon. Other conventional cyanide leach processes can be used with the pretreatment method of this invention to make refractory ores amenable to cyanide leaching. The pretreatment method of this invention is not limited to any particular cyanide leach technique.

Referring to FIG. 1, a sulfidic gold-containing ore 1 which is refractory to conventional cyanidation techniques and which contains greater than 8 percent dolomite by weight is fed through a line 2 to a ball mill 5. The ball mill 5 also receives water 3 and a recycled coarse fraction of the ore through a line 4 from a cyclone separator 10. A slurry is thus produced in the ball mill 5 and contains about 70 percent solids. The ore is wet-ground in the ball mill 5 such that 90 percent of the ore solids pass through a 100 U.S. mesh screen. The effluent slurry from the ball mill 5 is passed through line 6 and collected in a sump 7 into which water 8 is added to adjust the slurry solids content to between about 35 and about 55 percent. The ore slurry is then fed through a line 9 to the cyclone separator 10. The cyclone separator 10 separates fine and coarse ore particles. As already stated coarse ore particles are recirculated from the cyclone separator 10 through a line 4 back to the ball mill 5. Fine ore particles are slurried at a solids content between about 20 to about 45 percent in the slurry. The fine ore particles are passed from the cyclone separator 10 through a line 11 to a mixing vessel 12 where an alkaline agent 13, such as lime, caustic soda, or preferably soda ash, is added to the ore slurry at the rate of about 50 to 100 pounds per ton of dry ore.

The ore slurry is then pumped through a line 14 into an autoclave 15 which is desirably a pressure vessel having internal baffles. Steam 16 and oxygen 17 are also fed directly into the autoclave 15. Other types of heating can be substituted for steam 16, however, the design of commercial autoclaves makes steam injection the most common or preferred heat source. Additional soda ash 18 can be supplied to the autoclave 15 if necessary to regulate the pH of the aqueous slurry. The autoclave 15 is operated at a temperature of between about 400° F. and about 500° F. and an oxygen overpressure of between about 50 psig and 100 psig. The autoclave baffles serve to increase slurry turbulence. Increased slurry turbulence within the autoclave improves the sulfidic compound oxidation kinetics. The baffles also serve to prevent "short circuiting" or backwashing of the ore slurry within the autoclave 15. The slurry enters at one end of the autoclave 15 and exits at the other end. The baffles within the autoclave 15 direct the flow of the slurry through the autoclave 15. The residence time of a unit of volume of the ore slurry in the autoclave 15 is at least 2 hours and preferably 4 hours. The residence time must be sufficient to allow the sulfidic compounds within the ore 1 to be oxidized. Soda ash can be added into the autoclave. Typically, acid is formed in the oxidation process within the autoclave 15 to cause the slurry pH to be lowered to about pH 5.0.

The ore slurry exits the autoclave 15 by a line 19. The or slurry is cooled by a conventional cooling vessel or equipment 20, that is preferably conventional "flash cooling" equipment. The aqueous slurry is then optionally transferred through line 21 to a liquid-solid separator 22 to form a liquid fraction and a solids fraction of the aqueous slurry. One type of solids separation equipment suitable for this service is a "thickener". Excess water is removed from the slurry via the liquid-solid separator and is transferred through line 23 to the tailings pond 24. The purpose of the liquid-solid separation step is twofold. Separation increases the percent solids in the slurry and simultaneously reduces the quantity of acidic slurry water requiring lime addition in a subsequent conditioning procedure. The amount of lime addition required during the conditioning procedure is, thus, slightly reduced. The increase in the solids concentrate of the slurry increases the residence time of ore particles in the cyanide leach step. The liquid-solid separation step can be deleted when the solids content of the ore exiting the autoclave is very high such as greater than about 40 percent by weight of the slurry.

After exiting the liquid-solid separator 22 or, as discussed above, the cooling vessel 20, the slurry is transferred through line 25 to a conditioning tank 26 into which lime 28 is added to adjust the slurry pH to about pH 10. Fresh water 27 can also be added to replace at least some of the acidic water removed if the liquid-solid separation step, discussed above, is performed. The conditioned ore slurry leaves the conditioning tank 26 through line 29 and is passed to a gold recovery circuit utilizing conventional cyanide leach techniques.

An essential feature of the present invention lies in the oxidizing step carried out in the autoclave. For example, iron sulfide ($FeS_2$) in pyritic ores is oxidized to ferric oxide. The oxidation of iron sulfide successfully reduces the refractory nature of a sulfidic gold-containing ore. The reason for this reduction in the refractory nature of the ore is not clearly understood. For purposes of this invention the term, autoclaving, represents a process that elevates the ore slurry temperature at a sufficient pressure and for a sufficient time to sufficiently oxidize a substantial amount of the sulfidic compounds in the ore to make the ore amenable to subsequent gold extraction.

The overall chemical reaction involved in oxidizing refractory sulfidic compounds of an ore is:

$$2FeS_2+15/2O_2+4H_2O\rightarrow Fe_2O_3+4H_2SO_4.$$

The formation of sulfuric acid in this reaction is responsible for the drop in ore slurry pH as the ore slurry moves through the autoclave.

The addition of soda ash or other alkaline agents to the ore slurry in the autoclave appears to favorably increase the kinetics of the oxidation reaction in the slurry. The addition of soda ash is believed to be instrumental in increasing the rate of sulfur oxidation through the overall reaction:

$$S^{=}+2O_2\rightarrow SO_4^{=}.$$

Any carbonaceous material contained in the slurry is also oxidized through a similar overall reaction. Other alkaline agents such as lime and caustic soda can be used in the autoclave. Soda ash has proven the most compatible alkaline agent for this method of autoclaving refractory sulfidic and carbonaceous gold-containing ores.

The method of the present invention is preferably performed in a continuous method for treating a refractory gold-containing ore. One skilled in the art can use the invented method in a series of slurry "batch" treating steps.

The disclosed process is intended for use on refractory sulfidic ores containing large quantities of basic carbonates. This process can also be effective on mixtures of refractory sulfidic and carbonaceous ores. Sulfidic ores are generally much more refractory than carbonaceous ores and mixtures of the two ores are normally processed as if the entire ore mixture was composed of refractory sulfidic ore.

EXAMPLES

The ore samples used in the following examples are obtained from an ore deposit near Elko, Nev. A mineralogical analysis of the ore is summarized in Table I below:

TABLE I

MINERALOGICAL ANALYSIS

| Mineral | Weight % |
|---|---|
| Illite/Muscovite | 37 |
| Quartz | 30 |
| Dolomite | 19 |
| Pyrite | 9 |
| Kaolinite | 1 |
| Hematite | 1 |
| Other | 2 |
| Gold | 6 parts per million |

The gold values of this ore were difficult to recover using conventional cyanidation gold-recovery technology. When conventional cyanidation procedures without preoxidation were employed with this ore, gold recovery was about 20 percent. When conventional cyanidation procedures with preoxidation of the refractory ore material were employed, gold recovery was about 40 percent. These poor gold recoveries were attributed to the high sulfide or pyrite content of the ore as shown in Table I.

The test procedure for these examples used batch tests. A sample of ore was ground using a laboratory pulverizer such that 90 percent to 100 percent of the ore passed through a 100 U.S. mesh screen. Batches of 200 to 400 grams of the pulverized ore were slurried with 600 to 800 milliliters of water and an alkaline agent such as soda ash, lime, or caustic soda. The test slurry was placed in a one-gallon capacity autoclave. The autoclave was heated by an electrical heating mantle. When the desired autoclave temperature was obtained, oxygen was injected into the autoclave until evidence of pyrite oxidation was observed. Pyrite oxidation is exemplified initially by a rising temperature and pressure in the autoclave. In most of the examples a four hour retention or residence time of the slurry in the autoclave was used. In certain examples residence times of the slurry in the autoclave ranged from two to six hours.

After completion of each autoclaving procedure, the heat source was shut off and the autoclave was allowed to cool to ambient temperature. Samples of the autoclaved slurry were then taken and the pH of each sample was adjusted to between pH 10 and pH 10.5 by adding lime. Sodium cyanide was added at a rate equivalent to 5 pounds per ton of ore solids. Westates brand activated carbon (6×16 mesh size) was added at a concentration of 20 grams per liter of slurry. Gold leaching and gold adsorption procedures were then performed on the slurry using rolling bottles to agitate the slurry. The slurries were agitated for 24 hours in the bottle-type agitator rolls. Following the 24 hour agitation period, each bottle was opened and the gold laden carbon was sieved or separated from the slurry using a size number 48 U.S. mesh screen. The carbon-free slurry was then filtered using a laboratory filter press to separate the test slurries into solid ore and liquid fractions. Both solid and liquid fractions were then analyzed for gold content.

EXAMPLE 1

This example illustrates the improved gold yield from a refractory sulfidic gold-containing ore using a pretreatment with soda ash and an autoclave temperature and pressure sufficient to oxidize the sulfidic compounds of the ore. In each test of this example, 200 grams of ore was crushed such that 90 percent to 100 percent passed through a 100 U.S. mesh screen. To this ore 800 milliliters of water having various doses of soda ash was added. The resulting ore slurries were pretreated for 4 hours in an autoclave under an oxygen overpressure of 100 psig. Individual tests were performed at temperatures between 300° F. to 500° F. Two soda ash concentrations were evaluated. These concentrations were equivalent to 50 and 100 pounds of soda ash per ton of dry ore. The percentage of gold extractions at the conditions tested are summarized in Table II as follows.

TABLE II

| PRETREATMENT WITH SODA ASH | | | |
|---|---|---|---|
| Test No. | Soda Ash Dosage lbs Soda Ash/Ton Ore Solids | Autoclave Temperature °F. | Gold Extraction % |
| 1 | 50 | 300 | 62 |
| 2 | 50 | 400 | 68 |
| 3 | 50 | 450 | 77 |
| 4 | 50 | 500 | 91 |
| 5 | 100 | 300 | 71 |
| 6 | 100 | 450 | 86 |
| 7 | 100 | 500 | 95 |

An autoclave temperature of 500° F. was required in this example to obtain a gold extraction in excess of 90 percent. A soda ash concentration equivalent to 100 pounds per ton of ore solids yielded slightly higher gold recoveries than did a soda ash concentration equivalent to 50 pounds per ton of ore solids.

EXAMPLE 2

In this example test conditions were identical to those described in Example 1 except that caustic soda was used as the alkaline agent in place of soda ash. The soda ash concentrations and test results are shown in Table III as follows:

TABLE III

| PRETREATMENT WITH CAUSTIC SODA | | | |
|---|---|---|---|
| Test No. | Caustic Soda Dosage lbs Soda Ash/Ton Ore Solids | Autoclave Temperature °F. | Gold Extraction % |
| 1 | 50 | 300 | 37 |
| 2 | 50 | 400 | 68 |
| 3 | 50 | 500 | 92 |
| 4 | 100 | 300 | 58 |
| 5 | 100 | 400 | 80 |
| 6 | 100 | 500 | 93 |

As in Example 1 the percent of gold extraction achieved in this example is directly related to both the autoclave temperature and the alkaline material or caustic soda concentration. Of these two variables, the autoclave temperature proved to have the most significant effect on the percent of gold extraction.

EXAMPLE 3

This example illustrates the results obtained with the invented method when lime is used as the alkaline agent. The autoclave test conditions of this example included a temperature of 500° F., an oxygen overpressure of 100 psig, and a residence time for the slurry in the autoclave of 4 hours. The percent of ore solids for the test slurries is shown in Table IV as follows:

TABLE IV

| PRETREATMENT WITH LIME | | | | |
|---|---|---|---|---|
| Test No. | Alkaline Agent | Reagent Dosage lbs Per Ton Of Ore Solids | Ore Slurry % Solids | Gold Extraction % |
| 1 | Lime | 50 | 20 | 92 |
| 2 | Lime | 50 | 30 | 62 |
| 3 | Lime | 50 | 30 | 61 |
| | and Soda Ash | 50 | | |

The test results of Table IV demonstrate that the use of lime as the alkaline pretreatment agent is effective in slurries containing 20 percent ore solids, but relatively ineffective in slurries containing 30 percent ore solids. This ineffectiveness in denser slurries can limit the use of lime to less dense slurries. This example demonstrates that the use of a lime and soda ash combination is no more effective in gold extraction than is the use of that amount of lime used without soda ash.

EXAMPLE 4

This example illustrates the influence of autoclave retention or residence time on the percent of gold extraction. Retention time in the autoclave was varied from between 2 to 6 hours. Three hundred grams of the ground ore were slurried with 700 milliliters of water. Soda ash was added at a rate equivalent to 100 pounds per dry ton. The tests were performed at 500° F. and 100 psig of oxygen. The residence times used in this example and the respective percents of gold extraction obtained at those residence times are illustrated in Table V as follows:

TABLE V

| EFFECT OF AUTOCLAVE RETENTION TIME ON PERCENT GOLD EXTRACTION | |
|---|---|
| Autoclave Retention Time | Gold Extraction % |
| 2 | 80 |
| 4 | 90 |
| 6 | 94 |

Table V illustrates that an autoclave retention time of 4 hours is sufficient to achieve a gold extraction of 90 percent from the refractory sulfidic gold-containing ore used in this example.

EXAMPLE 5

This example illustrates the effect of the use in the invented method of various alkaline agents as possible alternatives to the use of soda ash, caustic soda, and lime. The chemicals tested in this example were ammonia and sodium hypochlorite. The autoclave temperature was 500° F. for the test and the oxygen overpressure was 100 psig. A 4 hour residence time of the slurry in the autoclave was used. The solids content of the test slurries was 30 percent. The alkaline agents and their concentrations in the ore are listed in Table VI as follows:

TABLE VI

| PRETREATMENT WITH OTHER ALKALINE REAGENTS | | | | |
|---|---|---|---|---|
| Test No. | Reagent | Reagent Dosage lbs Per Ton of Ore | Ore Slurry % Solids | Gold Extraction % |
| 1 | $NH_3$ | 100 | 30 | 52 |
| 2 | NaOCl | 50 | 30 | 88 |

The results of this example when compared to the results of the other examples demonstrate that the use of ammonia in the pretreatment oxidation method of this invention obtains a lower percent of gold extraction than do other alkaline agents. This is believed to be due to the turbulent conditions of the ore in the autoclave causing the ammonia to foam. The foam generated in the turbulent conditions of the autoclave causes a back-pressure in the autoclave. This prevents the smooth entry of oxygen into the ore slurry in the autoclave.

The use of sodium hypochlorite in this example resulted in a gold extraction efficiency comparable to that of soda ash or caustic soda. Sodium hypochlorite is more expensive than soda ash, caustic soda, or lime, and is therefore not as cost effective as these other alkaline agents.

We claim:

1. A pretreatment method for recovering gold comprising:

(a) forming an aqueous slurry of refractory sulfidic gold-containing ore; and (b) subjecting said aqueous slurry in the presence of an alkaline material to an oxidation step, said oxidation step includes simultaneously:

(i) autoclaving said aqueous slurry and (ii) oxygenating said autoclaved aqueous slurry;

wherein said oxidation step is sufficient to oxidize refractory sulfidic compounds in said ore and said autoclaving being at a temperature of between about 400° F. and about 500° F. and an oxygen overpressure of between about 50 psig and about 100 psig for an aqueous slurry residence time in said autoclave sufficient to oxidize said refractory sulfidic compounds of said ore.

2. The method according to claim 1, wherein said aqueous slurry residence time in said autoclave is at least 2 hours.

3. The method according to claim 2, wherein a subsequent gold extraction process is conducted, said subsequent gold extraction process being a cyanide leach process.

4. The method according to claim 3 wherein said sulfidic compounds of said ore are substantially pyrite compounds.

5. The method according to claim 4, wherein said ore contains at least 8 percent dolomite.

6. The method according to claim 1, wherein said alkaline material is soda ash, said soda ash being in a concentration of between about 50 pounds and about 100 pounds per ton of dry ore.

7. A process for recovering gold comprising:

(a) forming an aqueous slurry of refractory sulfidic gold-containing ore with an alkaline material;

(b) subjecting said aqueous slurry to an oxidation step, said oxidation step includes simultaneously:

(i) autoclaving said aqueous slurry; and (ii) oxygenating said autoclaved aqueous slurry;

(c) cooling said oxidized aqueous slurry to about ambient temperature;

(d) adjusting said cooled aqueous slurry to about pH 10; and (e) conducting a cyanide leach of said liquid fraction of said aqueous slurry whereby said gold is separated from said aqueous slurry;

wherein said autoclaving is at a temperature of between about 400° F. and about 500° F. and an oxygen overpressure between about 50 psig and about 100 psig for an aqueous slurry residence time in said autoclave sufficient to oxidize said refractory sulfidic compounds of said ore.

8. The method according to claim 1, wherein said aqueous slurry residence time in said autoclave is at least 2 hours.

9. The method according to claim 8, wherein said sulfidic compounds of said ore are substantially pyrite compounds.

10. The method according to claim 9, wherein said ore contains at least 8 percent dolomite.

11. The method according to claim 1, wherein said alkaline material in soda ash, said soda ash being in a concentration of between about 50 pounds and about 100 pounds per ton of dry ore.

12. A method for recovering gold from refractory sulfidic gold-containing ore comprising:

(a) forming an aqueous slurry of said ore with a soluble alkaline material;

(b) subjecting said aqueous slurry to oxidation in an autoclave, said oxidation includes simultaneously:

(i) autoclaving said aqueous slurry, said autoclaving being at a temperature between about 400° F. and about 500° F.;

(ii) oxygenating said autoclaved aqueous slurry;

(c) cooling said oxidized aqueous slurry;

(d) thickening said aqueous slurry, said thickening includes separating a liquid fraction from said aqueous slurry whereby a solids fraction of said aqueous slurry having a solids concentration of greater than about 40 percent by weight is obtained;

(e) adding an alkaline agent in an amount sufficient to adjust said cooled aqueous slurry to about pH 10;

(f) simultaneously contracting the oxidized aqueous slurry in a plurality of stages with a cyanide complexing agent and a granular activated carbon, said activated carbon being circulated contercurrent to said cyanide aqueous slurry, a temperature of said cyanide aqueous slurry being maintained between about 40° F. and 100° F. whereby said gold is absorbed on said activated carbon; and (g) separating said gold laden activated carbon from said aqueous slurry.

13. The method according to claim 12, wherein said alkaline material is $Na_2CO_3$.

14. The method according to claim 13, wherein said aqueous slurry residence time in said autoclave is at least 2 hours.

15. The method according to claim 14, wherein said oxygenating in said autoclave includes feeding an oxygen containing gas at an overpressure between about 50 psig and 100 psig.

16. A method for recovering gold from gold containing ores comprising:

(a) forming an aqueous slurry of refractory sulfidic gold-containing ore having at least about 8 percent metal carbonates, said aqueous slurry having a solids content between about 20 percent and about 45 percent by weight;

(b) adding $Na_2CO_3$ to said aqueous slurry at a rate of between about 50 pounds and about 100 pounds of $Na_2CO_3$ per ton of dry ore;

(c) autoclaving said formed aqueous slurry for an autoclave residence time of at least 2 hours in an autoclave at a temperature between about 400° F. and about 500° F. while simultaneously oxygenating said slurry by feeding an oxygen containing gas into said autoclave at an overpressure between about 50 psig and about 100 psig;

(d) cooling the oxidized aqueous slurry;

(e) thickening said aqueous slurry, said thickening includes separating a liquid fraction from said aqueous slurry whereby a solids fraction of said aqueous slurry having a solids concentration of greater than about 40 percent by weight is obtained;

(f) adding an alkaline agent in an amount sufficient to adjust said cooled aqueous slurry to about pH 10; and (g) recovering gold from said aqueous slurry utilizing a cyanide leach technique.

* * * * *